US010362826B2

(12) United States Patent
Wang et al.

(10) Patent No.: US 10,362,826 B2
(45) Date of Patent: Jul. 30, 2019

(54) HAT AND HAT BRIM LENGTH ADJUSTING METHOD

(71) Applicants: BOE TECHNOLOGY GROUP CO., LTD., Beijing (CN); BEIJING BOE OPTOELECTRONICS TECHNOLOGY CO., LTD., Beijing (CN)

(72) Inventors: Lei Wang, Beijing (CN); Rui Xu, Beijing (CN); Xiaochuan Chen, Beijing (CN); Zhenhua Lv, Beijing (CN); Xiaoliang Ding, Beijing (CN); Peng Liu, Beijing (CN)

(73) Assignees: BOE TECHNOLOGY GROUP CO., LTD., Beijing (CN); BEIJING BOE OPTOELECTRONICS TECHNOLOGY CO., LTD., Beijing (CN)

( * ) Notice: Subject to any disclaimer, the term of this patent is extended or adjusted under 35 U.S.C. 154(b) by 497 days.

(21) Appl. No.: 15/086,516

(22) Filed: Mar. 31, 2016

(65) Prior Publication Data

US 2017/0049175 A1 Feb. 23, 2017

(30) Foreign Application Priority Data

Aug. 18, 2015 (CN) ..... 2015 1 0508235

(51) Int. Cl.
*A42B 1/00* (2006.01)
*A42B 1/22* (2006.01)
(Continued)

(52) U.S. Cl.
CPC ..... *A42B 1/065* (2013.01); *A42B 1/242* (2013.01)

(58) Field of Classification Search
CPC ..... A42B 1/061; A42B 1/062; A42B 1/063; A42B 1/065; A42B 1/20; A42B 1/22;
(Continued)

(56) References Cited

U.S. PATENT DOCUMENTS 213,415 A * 3/1879 Halvorson ..... A42B 1/201 2/171.03
566,326 A * 8/1896 Kirshner ..... A42B 1/247 2/10
(Continued)

FOREIGN PATENT DOCUMENTS

CN 201630301 U 11/2010
CN 201640585 U 11/2010
(Continued)

OTHER PUBLICATIONS

English machine translation of CN 103284377 A, performed by Espacenet.com. Translation performed on Jan. 2, 2019. (Year: 2013 ).*
(Continued)

*Primary Examiner* — Jameson D Collier
(74) *Attorney, Agent, or Firm* — Nath, Goldberg & Meyer; Joshua B. Goldberg

(57) ABSTRACT

A hat and a hat brim length adjusting method are provided to solve the problem that the hat brim length of the existing sunscreen hats cannot be adjusted in real time. The present hat includes a hat body and a hat brim which is retractable in length; the hat further includes a power supply, an adjustment unit and a detection unit; wherein the detection unit is used for detecting relations between a position of the sun and a position of a wearer's face in real time; and the adjustment unit is used for adjusting a length of the hat brim according to the detection result. The hat brim length of the present hat is adjustable, so that the hat not only can block
(Continued)

the sun for the wearer but also can provide a good sight angle for the wearer.

6 Claims, 4 Drawing Sheets

(51) Int. Cl.

| | |
|---|---|
| ***A42B 3/18*** | (2006.01) |
| ***A42B 3/22*** | (2006.01) |
| ***A61F 9/00*** | (2006.01) |
| ***F41H 1/04*** | (2006.01) |
| ***A42B 1/06*** | (2006.01) |
| ***A42B 1/24*** | (2006.01) |

(58) Field of Classification Search

CPC ..... A42B 1/24; A42B 1/242; A42B 1/008; A42B 1/064

USPC ... 2/6.3, 175.1, 195.1, 195.6, 195.7, 209.12, 2/12, 171, 195.2

See application file for complete search history.

(56) References Cited

U.S. PATENT DOCUMENTS 716,258 A * 12/1902 Maass ..... A42B 1/247 2/10
1,610,745 A * 12/1926 Castanaro ..... A42B 1/062 2/10
4,793,006 A * 12/1988 Dawson ..... A42B 1/065 2/10
5,075,898 A * 12/1991 Bedient ..... A42B 1/065 2/10
5,197,150 A * 3/1993 Bedient ..... A42B 1/065 2/10
5,203,694 A * 4/1993 Klein ..... A42B 1/006 2/171.2
5,487,191 A * 1/1996 Ridley ..... A42B 1/062 2/10
5,666,669 A 9/1997 Sewell
5,689,830 A * 11/1997 Pflum ..... A42B 1/065 2/10
5,749,618 A * 5/1998 Jones ..... B60J 3/0208 296/97.8
5,765,229 A * 6/1998 McLeod ..... A42B 1/062 2/172
5,839,125 A * 11/1998 Chen ..... A42B 1/065 2/195.1
6,003,156 A * 12/1999 Anderson ..... A42B 3/0466 2/410
D421,760 S * 3/2000 Fleck ..... D16/133
6,044,495 A * 4/2000 Ellman ..... A42B 1/064 2/195.1
6,088,837 A * 7/2000 Baker ..... A61F 9/045 2/10
6,189,949 B1 * 2/2001 Miller ..... B60J 3/0208 296/97.1
6,202,218 B1 * 3/2001 Chen ..... A42B 1/065 2/175.1
6,237,156 B1 * 5/2001 Ellman ..... A42B 1/064 2/10
6,752,146 B1 * 6/2004 Altshuler ..... A62B 17/04 128/201.25
D499,231 S * 12/2004 Toppel ..... D2/882
6,996,852 B1 * 2/2006 Cabrera ..... A42B 1/062 2/171
7,082,618 B1 * 8/2006 Muso ..... A42B 1/062 2/175.1
7,186,159 B1 * 3/2007 Baxter ..... A42B 1/12 2/422
2003/0172437 A1 * 9/2003 Guerra ..... A42B 1/065 2/171
2005/0257310 A1 * 11/2005 Jang ..... A42B 1/062 2/209.13
2008/0256687 A1 * 10/2008 Spencer ..... A42B 3/046 2/425
2011/0055997 A1 * 3/2011 Tyler ..... A42B 1/063 2/172
2011/0184319 A1 * 7/2011 MacK ..... A42B 3/046 600/595
2012/0110718 A1 * 5/2012 Kim ..... A42B 1/065 2/209.12
2013/0033852 A1 * 2/2013 Liao ..... A42B 1/24 362/106
2016/0015108 A1 * 1/2016 Bertron ..... A42B 1/065 2/423

FOREIGN PATENT DOCUMENTS

CN 201878830 U 6/2011
CN 202127883 U 2/2012
CN 202168480 U 3/2012
CN 103284377 A 9/2013
CN 103844425 A 6/2014
CN 104665055 A 6/2015
CN 205040716 U 2/2016
DE 3715714 A1 * 2/1988 ..... A42B 1/18
GB 2519550 A * 4/2015 ..... A42B 1/242
KR 20140034656 A 3/2014

OTHER PUBLICATIONS

First Office Action dated Aug. 31, 2017 corresponding Chinese application No. 201510508235.6.

* cited by examiner

HAT AND HAT BRIM LENGTH ADJUSTING METHOD

FIELD OF THE INVENTION

The present disclosure belongs to the technical field of hats, and specifically relates to a hat and a hat brim length adjusting method.

BACKGROUND OF THE INVENTION

After the skin is excessively exposed in ultraviolet, epidermal cells are injured. Tyrosinase is activated to accelerate pigment synthesis, destroy the moisturizing function of the skin, so that the skin becomes dry, elastic fibers in the corium layer are injured, and fine lines are generated. Also the skin may be inflammatory and burnt under intensive irradiation. Pigmentary skin cancer and the like may occur under exceptional conditions. Sunshine may be accumulated, and long-term accumulation of skin injury may lead to the phenomena of skin suntan, flecks on the face, skin elasticity losing, wrinkles, ageing and the like. Long-brim hats are popular due to the advantages of being convenient for outgoing and light in wearing. However, the height of the sun is different in different seasons and at different time in a day, and the sunlight incident angle is changing all the time. For example, in the morning, the sun is low, the incident angle is small and a large area is irradiated, while at noon, the sun is high, the incident angle is large and a small area is irradiated, so a very wide hat brim is needed for all-day protection. However, a too wide hat brim may block the sight and affect outgoing and the enjoyment of scenery.

SUMMARY OF THE INVENTION

In view of the above problems of the brim of the existing hat, the embodiments of the present disclosure provides a hat with a hat brim the length of which is adjustable in real time and a method for adjusting the length of the hat brim.

A hat according to the embodiments of the present disclosure includes a hat body, a hat brim which is retractable in length, a power supply, an adjustment unit and a detection unit; wherein

- the detection unit is used for detecting a relation between a position of the sun and a position of a wearer's face in real time, so as to provide information for adjusting a length of the hat brim to the adjustment unit; and
- the adjustment unit is used for adjusting the length of the hat brim according to the information provided by the detection unit.

Optionally, the detection unit includes a sun angle detector and a sun direction detector, wherein

- the sun direction detector is used for detecting directions of the sun relative to the wearer's face, including three cases in which the sun is front, right-above or back of the wearer's face; and
- the sun angle detector is used for, when the sun is detected in front of the wearer's face, detecting the angle between the direction of the connecting line of the position of the sun and the lower jaw of the wearer and the direction of the extension line of the hat brim.

Alternatively, the detection unit further includes a ranging module and a calculation module; wherein

- the ranging module is used for measuring the length of the wearer's face; and
- the calculation module is used for, when the sun is detected in front of the wearer's face, calculating the length L of the hat brim at that time according to the angle $\alpha$ between the direction of the connecting line of the position of the sun and the lower jaw of the wearer and the direction of the extension line of the hat brim as detected by the sun angle detector and the length a of the wearer's face as measured by the ranging module, wherein $L=a\times\cot\alpha$.

Alternatively, the detection unit includes an information input module and a calculation module; wherein

- the information input module is used for inputting the length a of the wearer's face; and
- the calculation module is used for calculating the length L of the hat brim at that time according to the angle $\alpha$ between the direction of the connecting line of the position of the sun and the lower jaw of the wearer and the direction of the extension line of the hat brim as detected by the sun angle detector and the input length a of the wearer's face, wherein $L=a\times\cot\alpha$.

Optionally, the hat further includes a storage unit, which stores corresponding relations between the angle $\alpha$ between the direction of the connecting line of the position of the sun and the lower jaw of the wearer and the direction of the extension line of the hat brim, and the length L of the hat brim.

The sun angle detector is connected with the storage unit; and the adjustment unit adjusts the length of the hat brim according to the data stored in the storage unit.

Specifically, the sun angle detector is a photoelectric detector or a sun tracking sensor, e.g. a four-quadrant sensor, a five-quadrant sensor, an optical tube, etc.

Alternatively, the hat further includes a hat rope, wherein two ends of the hat rope are positioned on two sides of the hat body respectively; and the detection unit is fixed at a position of the hat rope below the lower jaw of the wearer.

The technical solution adopted for solving the technical problem of the embodiments of the present disclosure provides a hat brim length adjusting method, including:

- detecting, by a detection unit, relations between a position of the sun and a position of a wearer's face in real time; and
- adjusting, by an adjustment unit, a length of the hat brim according to the detection result.

Optionally, the step of detecting relations between a position of the sun and a position of a wearer's face in real time includes:

- detecting, by a sun direction detector, directions of the sun relative to the face of the wearer; including three cases in which the sun is front, right-above or back of the wearer's face; and
- detecting, by a sun angle detector, an angle $\alpha$ between the direction of the connecting line of the position of the sun and the lower jaw of the wearer and the direction of the extension line of the hat brim, if the sun is positioned in front of the wearer's face.

Alternatively, the step of adjusting the length of the hat brim according to the detection result includes:

- when detecting that the sun is positioned right above or in back of the wearer's face, adjusting the length of the hat brim to be the shortest;
- when detecting that the sun is positioned in front of the wearer's face, adjusting the length of the hat brim according to the detected angle $\alpha$ between the direction of the connecting line of the position of the sun and the lower jaw of the wearer and the direction of the extension line of the hat brim.

More preferably, the step of detecting relations between a position of the sun and a position of a wearer's face in real time includes:

measuring the length of the wearer's face; and when detecting that the sun is positioned in front of the wearer's face, calculating the length L of the hat brim at that time according to the angle α between the direction of the connecting line of the position of the sun and the lower jaw of the wearer and the direction of the extension line of the hat brim as detected by the sun angle detector, and the length a of the face of the wearer as measured by the ranging module; wherein $L=a\times\cot\alpha$.

BRIEF DESCRIPTIONS OF DRAWINGS

Figure 3:
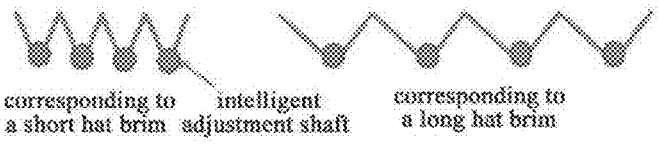
FIG. 3 and FIG. 4 are schematic diagrams of folded retractable structures in embodiments of the present disclosure.
Figure 4:
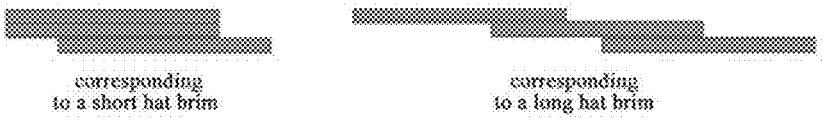
Figure 9A:
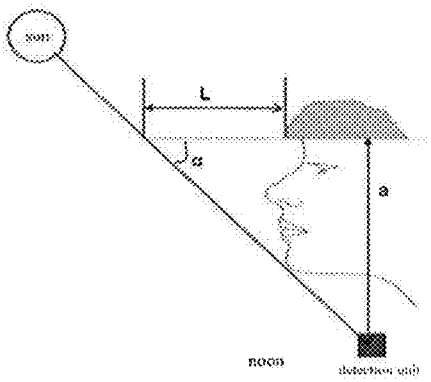
Figure 9B:
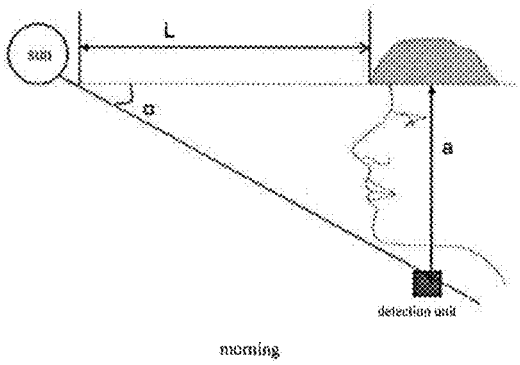

FIGS. 9*a* and 9*b* illustrate two schematic diagrams of a hat with a short hat brim (for example at noon) and a long hat brim (for example at morning) shown in FIGS. 3 and 4 according to an embodiment of the present disclosure.

Figure 10:
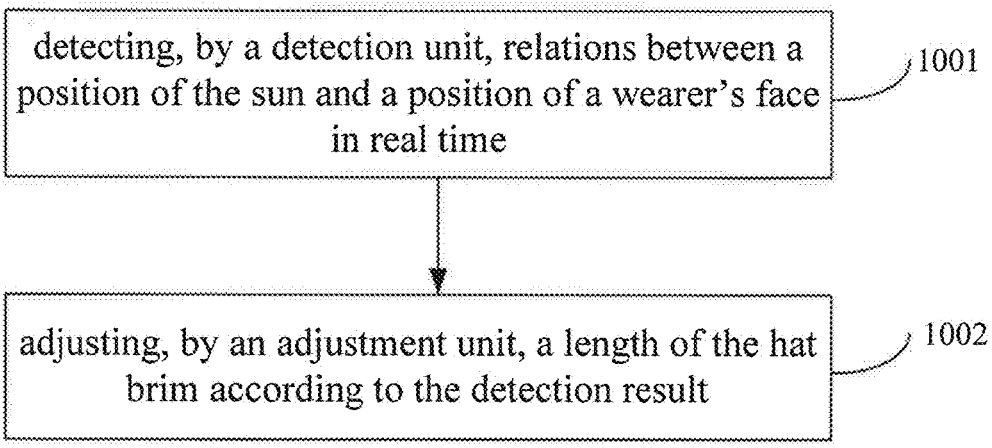

FIG. 10 shows a flow chart illustrating a hat brim length adjusting method according to an embodiment of the present disclosure.

DETAILED DESCRIPTIONS OF THE EMBODIMENTS

In order that those skilled in the art better understand the technical solutions of the embodiments of the present disclosure, the embodiments of the present disclosure will be further described in detail below in conjunction with the accompanying drawings and specific embodiments.

Figure 1:
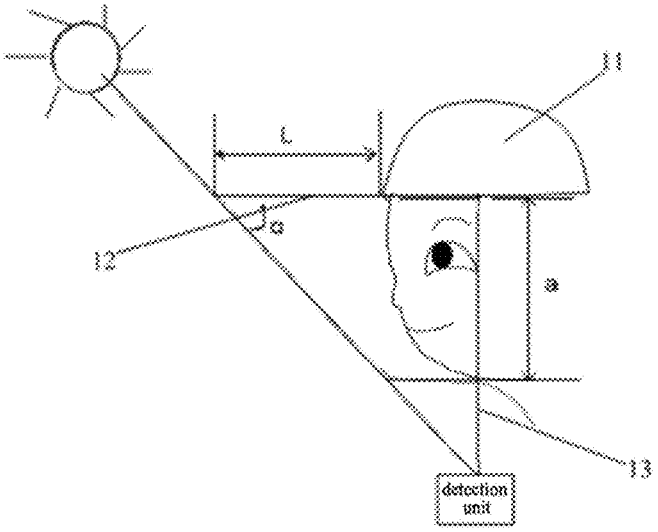
FIG. 1 is a schematic diagram of a hat according to an embodiment of the present disclosure.
Figure 2:
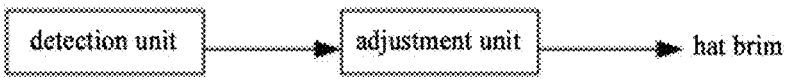
FIG. 2 is a schematic diagram of a hat in one embodiment of the present disclosure.

As shown in FIGS. 1 and 2, a hat in one embodiment of the disclosure includes a hat body 11, a hat brim 12, a power supply, an adjustment unit and a detection unit; wherein the hat brim 12 is a retractable hat brim 12; the detection unit is used for detecting relations between a position of the sun and a position of a wearer's face in real time, so as to provide information for adjusting a length of the hat brim to the adjustment unit; and the adjustment unit is used for adjusting the length of the hat brim 12 according to the information provided by the detection unit.

The retractable hat brim 12 according to one embodiment of the present disclosure may include a folded retractable structure as shown in FIG. 3 or a stepwise superposition structure in FIG. 4. In a folded retractable structure, a length of which can be adjusted as needed, wherein the distance between each shaft can be changed through an intelligent adjustment shaft to obtain a different length of the hat brim;

In a stepwise superposition structure, wherein multiple layers in the structure are superposed together when a short length of the hat brim is needed, and the structure can be extended outwards layer by layer when an increased length is needed.

The length of the retractable hat brim 12 of the hat provided by this embodiment can be adjusted in real time by the adjustment unit according to the information provided in real time by the detection unit, so that the length of the hat brim 12 not only can meet the sun screening requirement of the wearer, but also can ensure good sight of the wearer.

Figure 5:
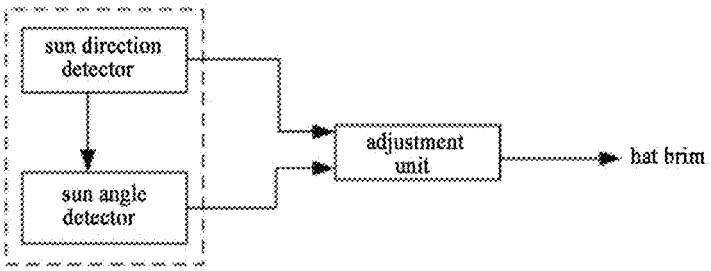
FIG. 5 and FIG. 6 are schematic diagrams of a hat in another embodiment of the present disclosure.

In another embodiment of the present disclosure, as shown in FIGS. 1 and 5, the detection unit of the hat according to the present disclosure includes a sun angle detector and a sun direction detector; the sun direction detector is used for detecting directions of the sun relative to the wearer's face; including three cases in which the sun is front, right-above or back of the wearer's face; the sun angle detector is used for, when the sun is detected in front of the wearer's face, detecting the angle α between the direction of the connecting line of a position of the sun and the lower jaw of the wearer and the direction of the extension line of the hat brim 12; and the adjustment unit is used for adjusting a length of the hat brim 12 according to the detection result.

Specifically, when the sun direction detector detects that the sun is positioned right above or in back of the wearer's face, that is to say, the sun does not irradiate the wearer's face at that time, then the length of the hat brim 12 can be adjusted to be the shortest by the adjustment unit t, so as to provide an optimal sight angle for the wearer.

When the sun direction detector detects that the sun is positioned in front of the wearer's face, that is to say, the sun may irradiate the wearer's face at that time, then the sun angle detector needs to detect the angle α between the direction of the connecting line of the position of the sun and the lower jaw of the wearer and the direction of the extension line of the hat brim 12; and the adjustment unit adjusts the length of the hat brim 12 according to the information of the angle.

Figure 6:
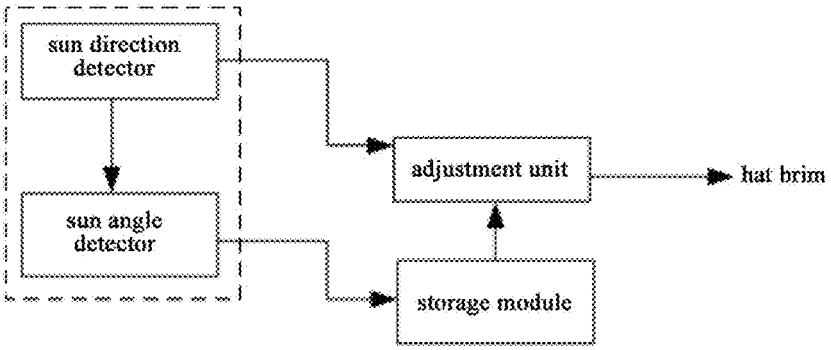

In yet another embodiment of the present disclosure, as shown in FIG. 6, the detection unit of the hat in the present disclosure is further provided with a storage unit, which stores the corresponding relations between the angle α and the length L of the hat brim 12; the sun angle detector is connected with the storage unit; and the adjustment unit adjusts the length of the hat brim 12 according to the data stored in the storage unit.

That is to say, after the sun angle detector detects the angle α between the direction of the connecting line of the position of the sun and the lower jaw of the wearer and the direction of the extension line of the hat brim 12, a datum of the length of the hat brim 12 is found in the storage unit through the angle, and finally, the adjustment unit adjusts the length of the hat brim 12 according to the datum.

Figure 7:
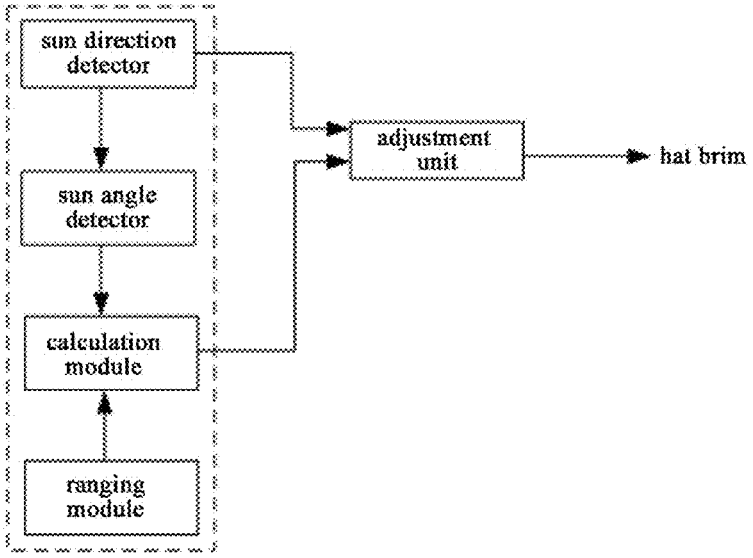
FIG. 7 is a schematic diagram of a hat in yet another embodiment of the present disclosure.

In a further embodiment of the present disclosure, as shown in FIGS. 1 and 7, the detection unit of the hat in the present disclosure further includes a ranging module and a calculation module in addition to the sun angle detector and the sun direction detector; the ranging module is used for measuring a length of the wearer's face; and the calculation module is used for, when the sun is detected in front of the wearer's face, calculating the length of the hat brim 12 at that time according to the angle α between the direction of the connecting line of the position of the sun and the lower jaw of the wearer and the direction of the extension line of the hat brim 12 as detected by the sun angle detector, and the length of the face of the wearer as measured by the ranging module. The functions of the ranging module and the calculation module will be specifically described below.

As face lengths of different wearers are different, the ranging module is added to the detection unit; the face length value a measured thereby is input to the calculation module, and the calculation module calculates the length L of the hat brim 12 at that time according to the angle α detected by the sun angle detector and the face length a of the wearer as detected by the ranging module; specifically, accordingly to a formula L=a×cot α. In this case, the calculated length of the hat brim 12 is more accurate; and finally, the adjustment unit adjusts the length of the hat brim 12 according to the calculation result.

Figure 8:
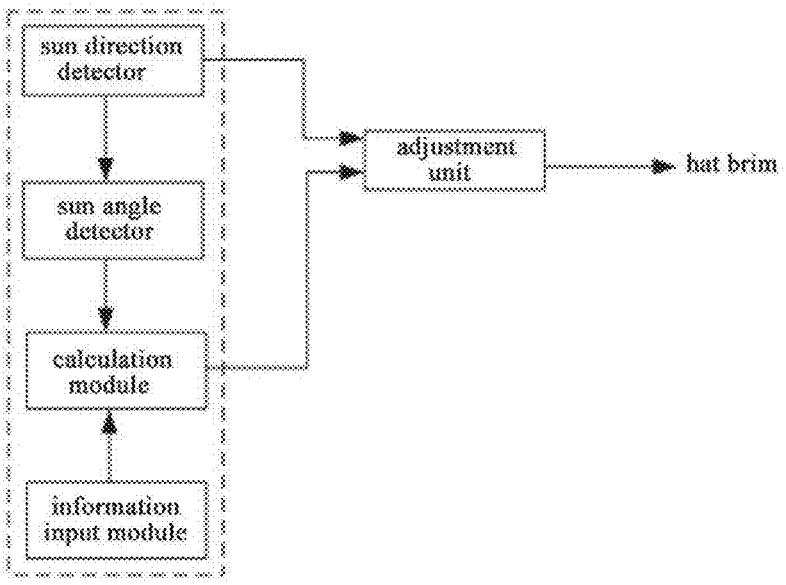
FIG. 8 is a schematic diagram of a hat in a further embodiment of the present disclosure.

As shown in FIGS. 1 and 8, the detector of the hat in the embodiments of the present disclosure includes a sun angle detector, a sun direction detector, an information input module and a calculation module. The functions of the sun direction detector and the sun angle detector are the same as those described above. The information input module is used for inputting face length information of the wearer; and the calculation module is used for calculating the length of the hat brim 12 at that time according to the angle α between the direction of the connecting line of the position of the sun and the lower jaw of the wearer and the direction of the extension line of the hat brim 12 as detected by the sun angle detector and the input face length information of the wearer.

The information input mode of the information input module is to manually input a premeasured face length of the wearer to the information input module. The information input module transmits the face length information of the wearer to the calculation module, and the calculation method of the calculation module is the same as that above.

The sun angle detector of the embodiments of the present disclosure is preferably any one of a four-quadrant sensor, a five-quadrant sensor and an optical tube, and may also be other detecting devices, which are not limited in the present disclosure.

The hat according to the present disclosure preferably includes a hat rope 13, wherein two ends of the hat rope 13 are positioned on two sides of the hat body 11 respectively; and the detection unit is fixed at a position of the hat rope 13 below the lower jaw of the wearer. Of course, the detection unit may also be arranged at other positions such as the collar of the wearer, as long as the position information of the sun can be detected.

In conclusion, according to the hat provided by each embodiment above, the position information of the sun relative to the wearer can be intelligently detected in real time, and the length of the hat brim 12 can be adjusted in real time, so that the sun screening requirement of the wearer is met and also a good sight angle is provided for the wearer.

Moreover, the embodiments of the present disclosure further provide a method for adjusting a length of the hat brim 12, including:

detecting, by a detection unit, relations between a position of the sun and a position of a wearer's face in real time; and adjusting, by an adjustment unit, the length of the hat brim 12 according to the detection result.

According to the method for adjusting the length of the hat brim 12 provided by the embodiments of the present disclosure, the position of the sun and the position of the wearer's face are detected in real time, so as to adjust the length of the hat brim 12 in real time, so that the length of the hat brim 12 not only meets the sun screening requirement of the wearer, but also can provide a good sight angle for the wearer.

In the above method, the step of detecting relations between a position of the sun and a position of a wearer's face in real time includes:

detecting directions of the sun relative to the wearer's face, including three cases in which the sun is front, right-above or back of the wearer's face.

Specifically, when the sun is detected right above or in back of the wearer's face, that is to say, the sun does not irradiate the face of the wearer at that time, thus it is unnecessary to detect the angle α, and the length of the hat brim 12 is directly reduced to be the shortest, so as to provide an optimal sight angle for the wearer.

When the sun is detected in front of the wearer's face, that is to say, the sun may irradiate the face of the wearer at that time, the angle α between the direction of the connecting line of the position of the sun and the lower jaw of the wearer and the direction of the extension line of the hat brim 12 is detected then, wherein the angle α corresponds to a length datum (stored in a storage unit) of the hat brim 12; and then the length of the hat brim 12 is adjusted according to the angle information.

In the above method, the step of detecting relations between a position of the sun and a position of a wearer's face in real time includes:

detecting directions of the sun relative to the face of the wearer, including three cases in which the sun is front, fight-above or back of the wearer's face.

Specifically, when the sun is detected right above or in back of the face of the wearer, that is to say, the sun does not irradiate the face of the wearer at that time, thus it is unnecessary to detect the angle α, and the length of the hat brim 12 is directly reduced to be the shortest, to provide an optimal sight angle for the wearer.

When the sun is detected in front of the wearer's face, that is to say, the sun may irradiate the face of the wearer at that time, the angle between the direction of the connecting line of the position of the sun and the lower jaw of the wearer and the direction of the extension line of the hat brim 12 is detected then; and a face length of the wearer is also detected; finally, a length L of the hat brim 12 at that time is calculated according to the detected angle α between the direction of the connecting line of the position of the sun and the lower jaw of the wearer and the direction of the extension line of the hat brim 12, and the length a of the face of the wearer as measured by a ranging module; specifically, according to a formula L=a×cat α.

Face lengths of different wearers are measured in the method, so that the calculated length of the hat brim 12 is more accurate, and the adjusting method not only can meet the sun screening requirement of the wearer, but also can provide a good sight angle for the wearer.

It could be understood that the above embodiments are merely exemplary embodiments adopted for describing the principle of the embodiments of the present disclosure, but the embodiments of the present disclosure is not limited thereto. Various variations and improvements may be made by those of ordinary skill in the art without departing from the spirit and essence of the embodiments of the present disclosure, and these variations and improvements shall also be regarded as falling into the protection scope of the embodiments of the present disclosure.

The invention claimed is:

1. A hat, comprising a hat body and a hat brim, wherein the hat brim is retractable in length; the hat further comprises an adjustment unit and a detection unit; wherein the detection unit is configured to detect relations between a position of the sun and a position of a wearer's face in real time, so as to provide information for adjusting the length of the hat brim to the adjustment unit; and the adjustment unit is configured to adjust the length of the hat brim according to the information provided by the detection unit, the detection unit comprises a sun angle detector and a sun direction detector;

the sun direction detector is configured to detect directions of the sun relative to the wearer's face, including three cases in which the sun is in front of the wearer's face, right-above the wearer's face or in back of the wearer's face; and when the sun is detected in front of the wearer's face, the sun angle detector is configured to detect an angle $\alpha$ between a direction of a line connecting the position of the sun with a lower jaw of the wearer and a direction of an extension line of the hat brim, the detection unit further comprises a calculation module and one or both of a ranging module and an information input module;

the ranging module is configured to measure a vertical length A of the wearer's face;

the information input module is configured to be used to input the vertical length A of the wearer's face; and the calculation module is configured to calculate a length L of the hat brim at that time according to the angle $\alpha$ and the vertical length A of the wearer's face as either measured by the ranging module or (ii) inputted by the information input module, wherein $L=A\times\cot\alpha$.

2. The hat of claim 1, wherein the hat further comprises a storage unit, wherein the storage unit is configured to store corresponding relations between the angle $\alpha$ and the length L of the hat brim;

the sun angle detector is configured to provide real-time data of the angle $\alpha$ to the storage unit; and the adjustment unit is configured to adjust the length of the hat brim according to the data of the length L provided by the storage unit.

3. The hat of claim 1, wherein the sun angle detector is any one of a four-quadrant sensor, a five-quadrant sensor and an optical tube.

4. The hat of claim 1, wherein the hat further comprises a hat rope, and two ends of the hat rope are positioned on two sides of the hat body respectively; and the detection unit is fixed at a position on the hat rope, wherein a distance between the position on the hat rope and the hat brim is configured to be larger than the length of the wearer's face.

5. A hat brim length adjusting method, comprising:

using a detection unit to detect relations between a position of the sun and a position of a wearer's face in real time; and using an adjustment unit to adjust a length of a hat brim according to the detection result, the step of detecting relations between the position of the sun and the position of the wearer's face in real time comprises: using a sun direction detector to detect a direction of the sun relative to the wearer's face, including three cases in which the direction of the sun is (i) in front of the wearers face, (ii) right-above the wearer's face or (iii) in back of the wearer's face;

and when the sun is detected in front of the wearer's face, using a sun angle detector to detect an angle $\alpha$ between a direction of a line connecting the position of the sun and a lower jaw of the wearer and a direction of an extension line of the hat brim;

the step of detecting relations between the position of the sun and the position of the wearer's face in real time further comprises: measuring a vertical length A of the wearer's face;

the step of adjusting the length of the hat brim comprises: calculating a length L of the hat brim at that time according to the angle $\alpha$ and the measured vertical length A of the wearer's face, wherein $L=A\times\cot\alpha$.

6. The hat brim length adjusting method of claim 5, wherein the step of adjusting the length of the hat brim according to the detection result comprises:

when the sun is detected either (ii) right above the wearer's face or (iii) in back of the wearer's face, adjusting the length of the hat brim to be a shortest length;

when the sun is detected (i) in front of the wearer's face, adjusting the length of the hat brim according to the angle $\alpha$.

* * * * *